US005347350A

United States Patent [19]

Nakahata et al.

[11] Patent Number: 5,347,350

[45] Date of Patent: Sep. 13, 1994

[54] SHEET FEEDER

[75] Inventors: Akinobu Nakahata, Sakai; Hiroshi Kubota, Osaka; Kouji Migita, Sakai; Masami Fuchi, Neyagawa; Kenji Oda, Toyonaka; Yoshinori Makiura, Kawachinagano; Katsuhide Yamaguchi, Takatsuki, all of Japan

[73] Assignee: Mita Industrial Co., Ltd., Osaka, Japan

[21] Appl. No.: 127,469

[22] Filed: Sep. 24, 1993

Related U.S. Application Data

[63] Continuation of Ser. No. 935,117, Aug. 24, 1992, abandoned.

[30] Foreign Application Priority Data

Aug. 28, 1991 [JP] Japan ..... 3-215690
Sep. 3, 1991 [JP] Japan ..... 3-223106

[51] Int. Cl.[5] ..... G03G 15/00; G03G 21/00

[52] U.S. Cl. ..... 355/309; 271/9; 271/153; 271/258; 355/308

[58] Field of Search ..... 355/203, 204, 208, 209, 355/308, 309, 311; 271/9, 110, 152, 153, 167, 258

[56] References Cited

U.S. PATENT DOCUMENTS

H21 2/1986 Schieck .
4,229,113 10/1980 Anderson et al. .
4,472,049 9/1984 Honma et al. ..... 355/206
4,524,691 6/1985 Miller .
4,535,463 8/1985 Ito et al. ..... 271/110 X
4,603,846 8/1986 Miles .
4,733,310 3/1988 Kapp et al. .
4,860,055 8/1989 Ohira et al. ..... 355/308
4,991,830 2/1991 Yamanaka ..... 271/9
5,076,562 12/1991 Sai et al. ..... 271/9
5,102,112 4/1992 Takahashi ..... 271/9
5,104,111 4/1992 Matsuda et al. ..... 271/110

*Primary Examiner*—A. T. Grimley
*Assistant Examiner*—Sandra L. Brase
*Attorney, Agent, or Firm*—Jordan and Hamburg

[57] ABSTRACT

A sheet feeder includes a feeder for feeding a sheet, a cassette for containing a plurality of stacks of small sized sheets side by side therein, the cassette including a plurality of biasing members for biasing the respective stacks of small sized sheets upwards so as to bring uppermost sheets of the respective stacks into contact with the feeder, a plurality of sheet detectors arranged in positions corresponding to the respective stacks of sheets for detecting the height of the respective stacks of sheets contained in the cassette, and a controller responsive to the plurality of sheet detectors for determining the absence of sheet in the cassette when at least one of the plurality of sheet detectors detects that the height of the stack has become lower than a predetermined height, and stopping a sheet feeding operation. This sheet feeder prevents the transfer device of an image forming apparatus from being smeared due to the fact that the small sized sheet is fed from only one stack.

18 Claims, 11 Drawing Sheets

SHEET FEEDER

This application is a continuation, of application Ser. No. 07/935,117 filed Aug. 24, 1992 now abandoned.

FIELD OF THE INVENTION

This invention relates to a sheet feeder, particularly, to a sheet feeder for detecting the presence or absence of the sheet to be fed.

BACKGROUND OF THE INVENTION

A printer, or like image forming apparatus is known in which data such as addresses output from a data storage provided in a personal computer is formed on a photosensitive member as a toner image, and the formed toner image is transferred to a sheet material such as an envelop.

In such an image forming apparatus, a cassette containing stacks of small sized sheets side by side therein is attached to the apparatus, these small sized sheets are dispensed side by side from the cassette by a feed roller. Also, a sheet sensor is arranged above each stack of sheets defined in the cassette containing stacks of sheets arranged side by side so as to detect the presence or absence of the sheets contained therein. These sheet sensors consist essentially of a photointerrupter including a light emitting element and a photodetector, and a lever which is provided rotatably between the two elements and comes to contact with the uppermost one of the corresponding stack of sheets in the cassette due to the weight thereof. These sensors are designed to determine the presence of sheet in the cassette by detecting the height of the uppermost one of sheets (the level of the sheet stack) contained in the cassette.

In the conventional apparatus of this type, when the small sized sheets are fed side by side from the cassette, the sheets are kept being fed even if one stack of sheets have run out (there is no sheet fed along one of transport paths) until the other stack of sheets runs out. Thus, a toner image to be transferred to the sheet from the stack of sheets that have run out deposits on the transfer device and the transport path downstream therefrom, thereby smearing the same. Further, the smear on the transfer device and the like deposits on a sheet fed next, thereby smearing that sheet. As a countermeasure for this, it can be considered that the sheet feeding operation is stopped if any of the sheet sensors detects the absence of sheet.

Further, the image forming apparatus can be selectively attached to a cassette containing a single stack of large sized sheets therein. These large sized sheets are dispensed one by one from the cassette by another feed roller.

There are cases where envelopes are used as sheets. Since the envelopes have end portions thereof turned up in their finished forms, the thickness thereof is nonuniform. Thus, if a cassette containing a stack of large sized envelopes therein is attached to the image forming apparatus, the nonuniformity of the thickness of that stack in a widthwise direction of the cassette becomes conspicuous. As a result, even if the sheet sensor positioned above a portion of the stack of envelopes where the thickness is large detects the presence of the sheet properly, the lever of the sheet sensor positioned above a portion of the stack where the thickness is small may rotate down as much as the sheet sensor detects the absence of sheet.

Accordingly, if the control for a cassette containing stacks of small sized sheets is employed for a cassette containing a single stack of large sized sheets, the sheet feeding operation is liable to be stopped despite the presence of sheet in the cassette. This is because there is a height difference between opposite two sides of the stack of envelopes as described above, and the control for small sized sheet stops the sheet feeding operation when any one of the sheet sensors detects the absence of sheet.

SUMMARY OF THE INVENTION

It is an object of the invention to overcome the above problems and to provide a sheet feeder capable of conducting proper automatic sheet feeding control.

A sheet feeder of the invention comprises feeder means for feeding a sheet, cassette means for containing a plurality of stacks of small sized sheets side by side therein the cassette means including a plurality of biasing means for biasing the respective stacks of small sized sheets upwards so as to bring uppermost sheets of the respective stacks into contact with the feeder means, a plurality of sheet detector means arranged in positions corresponding to the respective stacks of sheets for detecting the height of the respective stacks of sheets contained in the cassette means, and control means responsive to the plurality of sheet detector means for determining the absence of sheet in the cassette means when at least one of the plurality of sheet detector means detects that the height of the stack has become lower than a predetermined height, and stopping a sheet feeding operation.

With the sheet feeder thus constructed, the plurality of sheet detector means detect the height of the respective stacks of sheets contained side by side. When at least one of the sheet detector means detects that the height of the stack has become lower than a predetermined height, the absence of sheet is determined. Simultaneously, the driving of the feeder means is stopped. Accordingly, the transfer device of an image forming apparatus is prevented from being smeared due to the fact that the sheet is not fed from at least one sheet stack.

Also, it may be appropriate to provide informing means for informing an operator of the absence of sheet when the control means determines the same. New sheets can be set promptly after the absence of sheet is detected.

Further, it may be appropriate to provide a secondary cassette means for containing a stack of large sized sheets, the secondary cassette means including biasing means for biasing the stack of large sized sheets upwards so as to bring an uppermost sheet of the stack into contact with the feeder means, cassette detector means for detecting whether the secondary cassette means is being in operation, and the control means further responsible to the cassette detector means and determines the absence of sheet in the cassette means when all the plurality of sheet detector means detect that the height of the stack has become lower than a predetermined height and the cassette detector means detects that the secondary cassette means is being in operation.

With this sheet feeder, when the secondary cassette containing large sized sheets is being in operation, the height of the stack of sheets contained in the cassette is detected by the plurality of sheet detector means. When all the sheet detector means detect that the height of the stack has become lower than a predetermined height, the absence of sheet is determined. The driving of the feeder means is automatically stopped. Accordingly, this sheet feeder, which is simple in construction, can prevent an erroneous detection which is liable to occur due to the warping of sheets caused by the nonuniform thickness of the large sized sheets in such a case as the large sized envelopes are contained in the cassette, and the presence or absence of sheet can be accurately detected.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
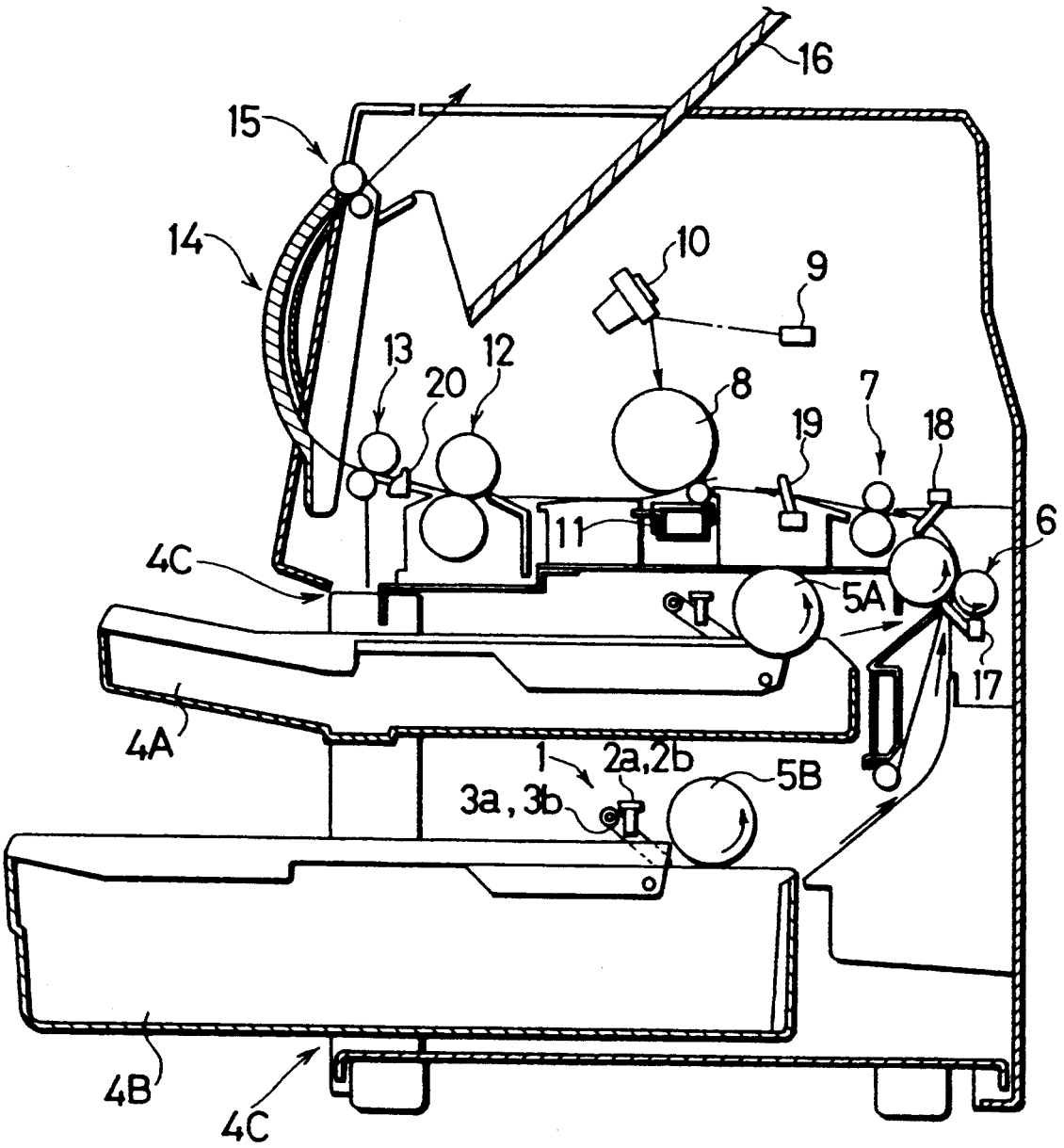
FIG. 1 is a diagram showing a schematic construction of an image forming apparatus incorporating a sheet feeder in accordance with the invention.

FIG. 1 is a schematic diagram showing an image forming apparatus in which a sheet feeder according to the invention is arranged.

The image forming apparatus provided with feed rollers 5A, 5B for feeding sheets, pairs of separating rollers 6 and registration rollers 7, a photosensitive member 8 in the form of a drum, unillustrated other imaging means arranged around the member a light emitting device 9 including a laser or the like, polygonal mirror 10, a transfer device 11, a fixing device 12 including fixing rollers 12, pairs of discharge rollers 13, 15, a discharge guide 14, a discharge tray 16, etc. In addition, cassettes 4A, 4B containing sheets therein are attachable to respective attachment portions 4C of the image forming apparatus.

Figure 2:
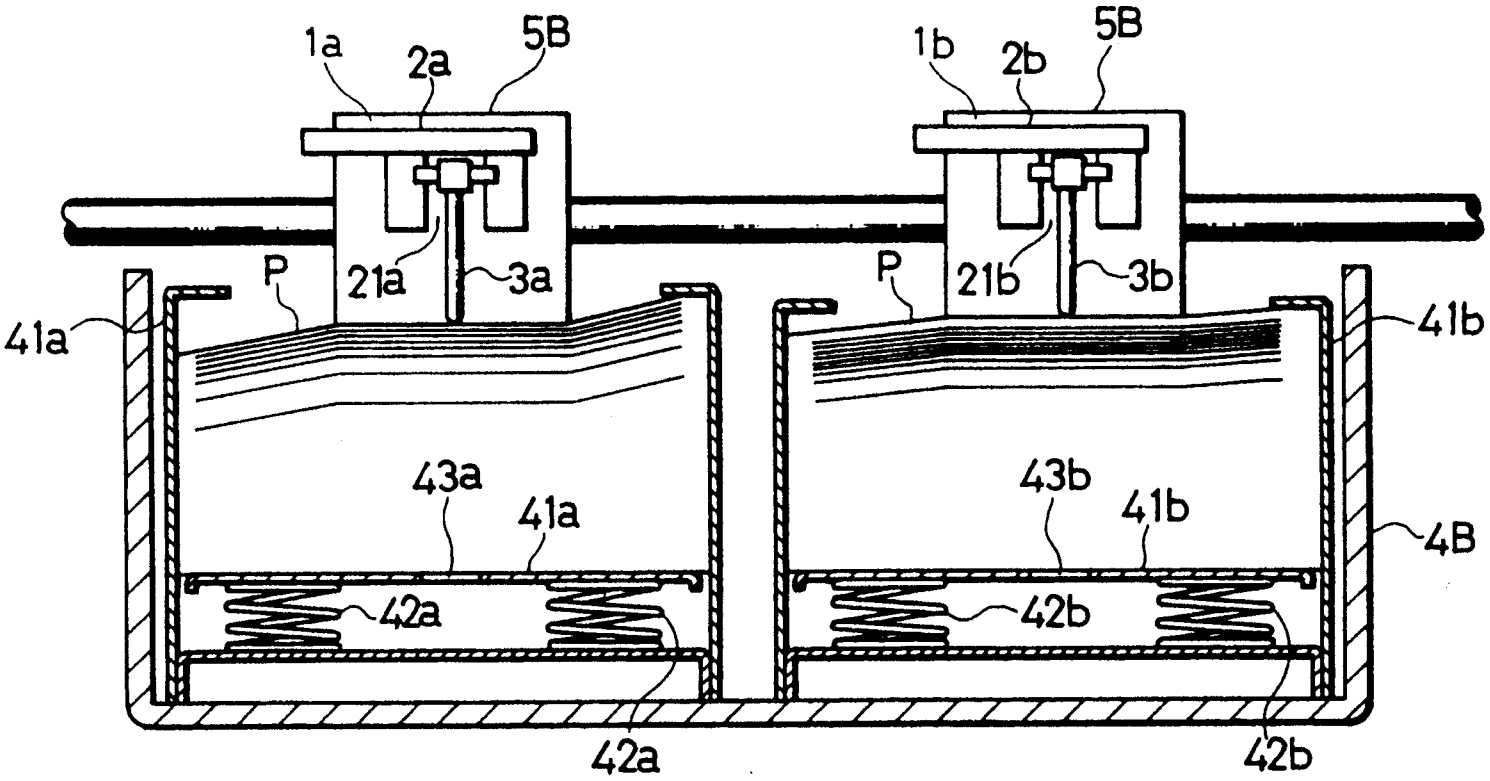
FIG. 2 is a sectional view showing a cassette and sheet sensors when the cassette containing stacks of small sized sheets side by side is attached to the image forming apparatus.

The cassette 4B, as shown in FIG. 2, has sheet aligning units 40*a*, 40*b* arranged side by side therein and is capable of containing stacks of small sized sheets in their aligning units.

The image forming apparatus includes a sheet sensor 1, a multifeed sensor 17, a registration sensor 18, a timing sensor 19, a discharge sensor 20, etc. The sheet sensor 1 detects the presence of the sheets contained in the cassette 4B. The multifeed sensor 17 detects a multiple feeding of sheets. The registration sensor 18 detects for a timing at which the registration rollers 7 are to be driven. The timing sensor 19 detects for a timing at which the light emitting device 9 or the like starts emitting the light. The discharge sensor 20 detects discharge of the sheet. It will be appreciated that these sensors are arranged along each of two paths of transport so as to detect the sheets being fed side by side.

The sheets stacked up in the cassette 4B are fed one by one to the separating rollers 6 from the uppermost sheet by the feed roller 5B, and further transported by the separating roller 6, thereby coming with contact with the registration rollers 7. The registration rollers 7 are controllably driven in accordance with a signal from the registration sensor 18.

On the other hand, in accordance with a signal from the timing sensor 19, an image signal input through an unillustrated data storage or the like externally connected to the image forming apparatus is optically modulated into a modulated beam (laser beam) in the light emitting device 9, and emitted therefrom, The photosensitive member 8 is exposed to the laser beam from the light emitting device 9 by way of the polygonal mirror 10. When the sheets are transported side by side, the same number of images as that of transport paths of sheets are formed on the surface of the photosensitive member 8 in juxtaposition with each other along an axial direction of the member 8 by the aforementioned imaging means. More specifically, the surface of the photosensitive member 8 is charged by an unillustrated charger, and electrostatic latent images are formed thereon by the exposure operation and developed into toner images by an unillustrated developing device.

These toner images are, after being transferred to the sheets by the transfer device 11, fixed onto the sheets by the fixing device 12. The sheets bearing the fixed toner images thereon are discharged onto the discharge tray 16 through the discharge guide 14.

An example of a specific construction of the sheet sensor 1 will be described next with reference to FIG. 2.

The sheet sensors 1*a*, 1*b* are arranged in specified positions of an image forming apparatus main body (to which sheets are fed) for detecting the height of the uppermost sheets contained in the cassette 4B respectively. These sensors 1*a*, 1*b* consist essentially of photointerrupters 2*a*, 2*b* each including, for example, a light emitting element and a photodetector, and levers 3*a*, 3*b* each rotatable between the corresponding light emitting element and photodetector. The sensors 1*a*, 1*b* are located above the sheet aligning units 40*a*, 40*b* respectively.

Figure 3:
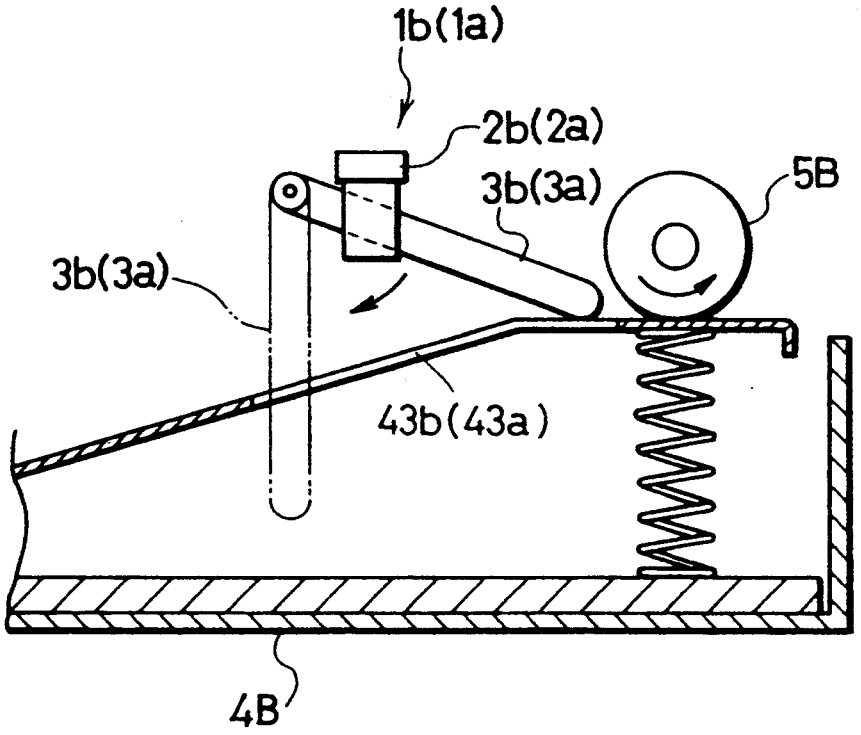
FIG. 3 is a schematic diagram showing an operation of the sheet sensor.

The levers 3*a*, 3*b* are constructed such that lower ends thereof come to contact with the uppermost one(s) of sheets P stacked up on sheet holding plates 41*a*, 41*b* of the sheet aligning units 40*a*, 40*b*. The holding plates 41*a*, 41*b* are biased upwards by helical springs 42*a*, 42*b* so that the uppermost ones of sheets P stacked thereon come into contact with the feed roller 5B with a suitable pressure. Further, as shown in Fig 3, there are defined oblong slots 43*a*, 43*b* extending in a sheet feeding direction in specified position of the holding plates 41*a*, 41*b*. The levers 3*a*, 3*b* are designed to rotate down to a vertical position (a position indicated by phantom line in FIG. 3) due to the weight thereof when the sheets P run out.

The photointerrupters 2*a*, 2*b* are turned on when the levers 3*a*, 3*b* are located in clearances 21*a*, 21*b* between the light emitting elements and photodetectors as represented by solid line in FIG. 3, while being turned off when the levers 3a, 3b are rotated down to be located in the aforementioned oblong slots 43a, 43b as represented by phantom line in FIG. 3.

The levers 3a, 3b, as illustrated, are freely rotatable. Accordingly, the cassette 4B is detachable from the image forming apparatus.

Figure 4:
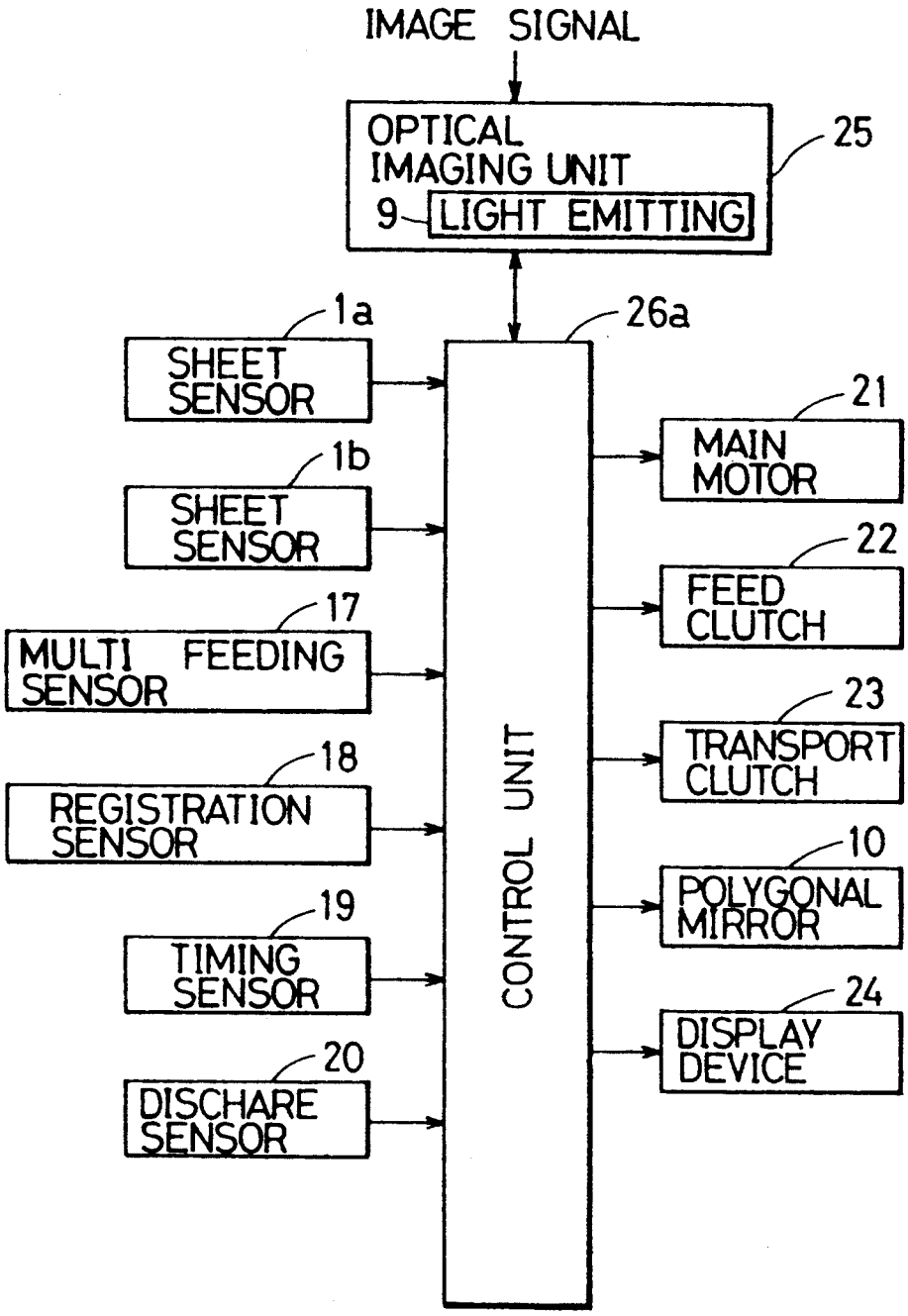
FIG. 4 is a block diagram showing a construction of a control system of the image forming apparatus.

A construction of a control system of the image forming apparatus next will now be described with reference to a block diagram shown in FIG. 4.

The control system includes an optical imaging unit 25, a control unit 26, etc. The optical imaging unit 25 processes an image signal from a data storage or the like externally connected to the image forming apparatus and causes the light emitting device 9 to output the beam representative of the processed image signal. Further, the optical imaging unit 25 is constructed in such a manner as not to activate the light emitting device 9 when an NOR circuit 262a to be described later outputs a low signal.

The control unit 26 controls a main motor 21 and clutches 22, 23 in accordance with sensor signals from the Sensors 1a, 1b, 17 to 20. Further, the control unit 26 determines the absence of sheet in the cassette 4B when one of the sheet sensors 1a, 1b detect that there is no sheet therein. Thereupon, the control unit 26 stops the feeding of sheet, outputs a signal indicative of the absence of sheet to a display device 24, and causes the device 24 to display the corresponding indication.

The main motor 21 drives the feed rollers 5A, 5B and separating rollers 6 through the clutches 22, 23 or the like. When the feed clutch 22 is engaged, the driving force of the main motor 21 is transmitted to a feed mechanism including the feed rollers 5A, 5B and separating rollers 6. When the transport clutch 23 is engaged, the driving force of the main motor 21 is transmitted to a transport mechanism including the registration rollers 7, discharge rollers 13, 15, and the like.

Figure 5:
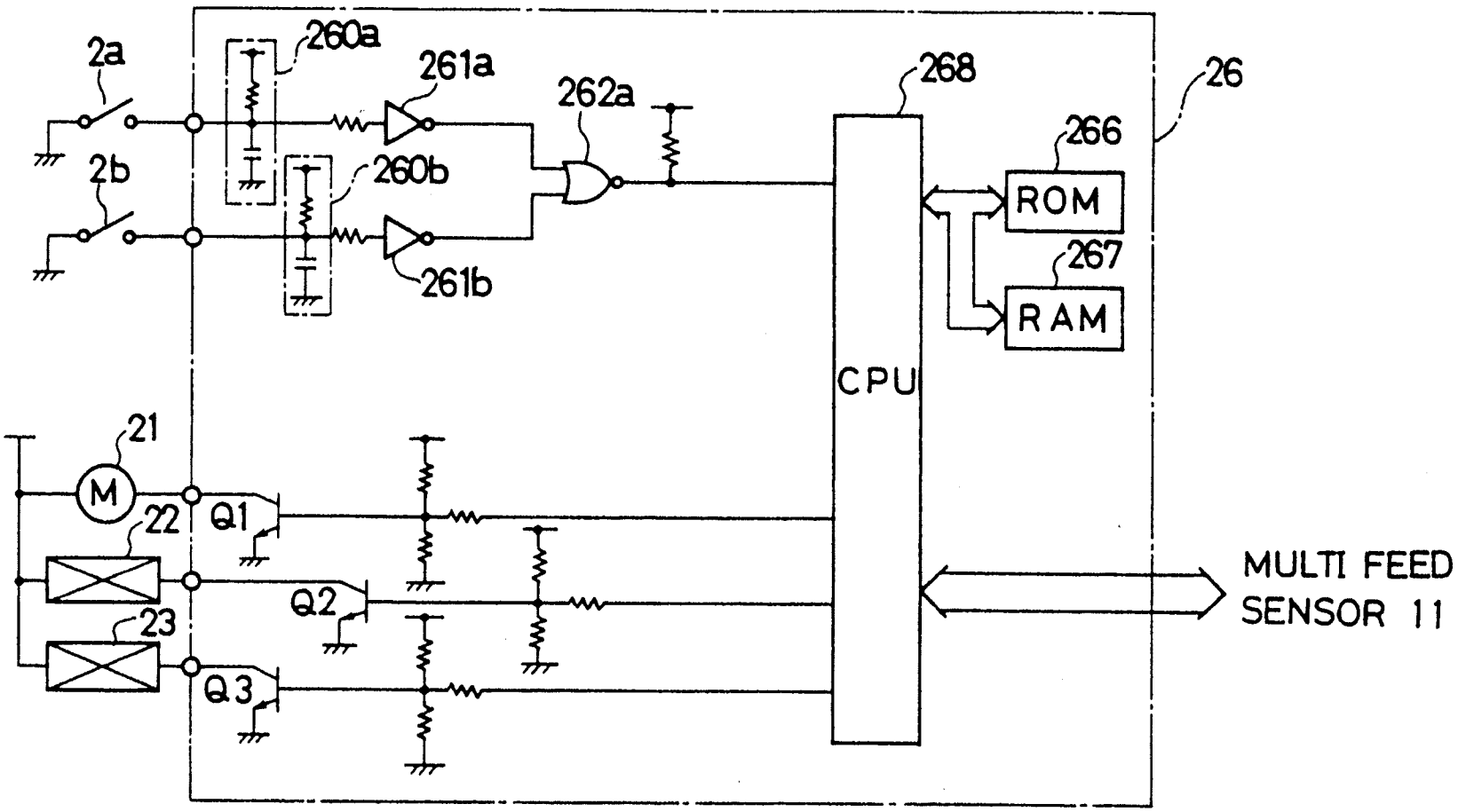
FIG. 5 is a circuit diagram showing a specific construction of the control system.

A specific construction of the control unit 26 will be described next with reference to a circuit diagram shown in FIG. 5.

The control unit 26 includes integrating circuits 260a, 260b, inverters 261a, 261b, NOR circuits 262a, a ROM 266, a RAM 267, a CPU 268, transistors Q1 to Q3, and the like.

Integrating circuits 260a, 260b each includes a resistor and a capacitor. The circuits 260a, 260b output high signals to the inverters 261a, 261b respectively when the photointerrupters 2a, 2b of the sheet sensors 1a, 1b are off. On the other hand, the circuits 260a, 260b output low signals to the inverters 261a, 261b when the photointerrupters 2a, 2b are on.

The inverters 261a, 261b invert output signals of the integrating circuits 260a, 260b, and output the inverted signals to the NOR circuit 262a. The inverters 261a, 261b each have a hysteresis characteristic so as to reduce the effect of chattering or the like of the photointerrupters 2a, 2b in cooperation with the integrating circuits 260a, 260b.

The NOR circuit 262a outputs a high signal to the CPU 268 when both inverters 261a, 261b output low signals while outputting a low signal to the CPU 268 when one of the inverters 261a, 261b outputs a high signal.

The CPU 268 determines the presence of sheet in the cassette 4B, i.e., the both sheet aligning units 40a, 40b have sheets, upon receipt of the high signal from the NOR circuit 262a, and drives the main motor 21 and clutches 22, 23 through the transistors Q1 to Q3 so as to execute a sheet feeding operation or the like. Further, the CPU 268 determines the absence of sheet in the cassette 4B, i.e., one of the two sheet aligning units 40a, 40b has no sheet, upon receipt of the low signal from the NOR circuit 262a, and turns off the transistors Q1 to Q3 so as to stop the sheet feeding operation or the like. In addition, the CPU 268 causes the display device 24 to display an indication indicating the absence of sheet.

The ROM 266 stores a main program and the like therein, and the RAM 267 stores various data therein.

Figure 6:
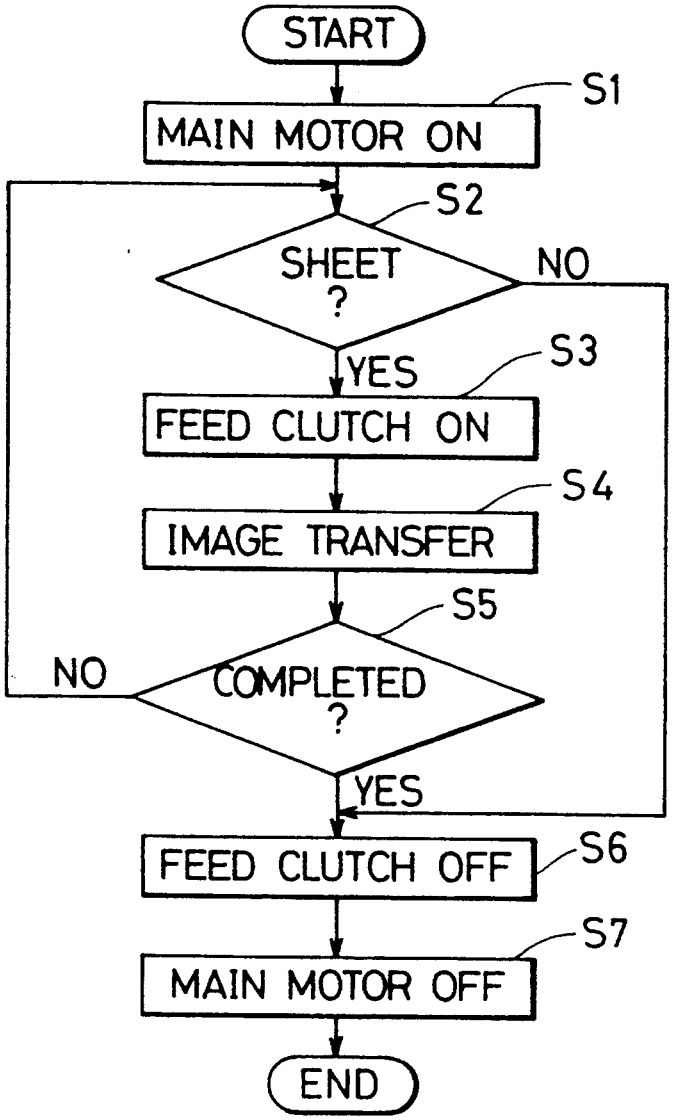
FIG. 6 is a flow chart showing an operation of controlling the driving of a feed roller.

Next, an operation of the control unit 26 will be described in accordance with a flow chart shown in FIG. 6.

Upon start of activation of CPU 268, the main motor 21 is driven in Step S1. Then, it is discriminated whether there is any sheet in the cassette 4B, i.e. whether the high signal is output from the NOR circuit 262a to the CPU 268 in Step S2.

If the high signal is output from the NOR circuit 262a to the CPU 268 (YES in Step S2), the CPU determines the presence of sheet in the cassette 4B and causes the feed clutch 22 to be engaged. Thereupon, the driving of the feed roller 5B is started to dispense the sheet from the cassette 4B in Step S3. In Step S4, a toner image is formed on the surface of the photosensitive member 8 and is transferred to the fed sheet. The transferred toner image is fixed onto the sheet, which is then discharged.

Thereafter, it is discriminated whether the copying operation has been carried out the number of times set through the unillustrated operation unit in Step S5. If there still remains any copy to be made (NO in Step S5), this routine returns to Step S2 so as to carry out the copying operation further. If the set number of copies have been made (YES in Step S5), the feed clutch 22 is disengaged in Step S6 and the main motor 21 is deenergized in Step S7, thereby completing this routine.

On the other hand, if the low signal is output from the NOR circuit 262a to the CPU 268 (NO in Step S2), the CPU 268 determines the absence of sheet in the cassette 4B and proceeds to Step S6 without executing the operations in Steps S3 to S5. Thereupon, the feed clutch 22 is disengaged and the sheet feeding operation by means of the feed roller 5B or the like is stopped. Further at this time, the indication is displayed in the display device so as to inform an operator of the absence of sheet in the cassette 4B. It will be noted that the copying operation is also stopped since no sheet is fed.

In this way, when the sheet runs out in either one of the sheet aligning units 40a, 40b and the NOR circuit 262a outputs the low signal to the CPU 268, the feed clutch 22 is disengaged to stop the sheet feeding operation. Accordingly, the event that the transfer device and the transport path downstream therefrom can be prevented from being smeared due to the fact that the small sized sheet dispensed from only the one aligning unit is transported.

Next, another embodiment of the present invention will be described. It should be noted that like reference numerals designate like parts throughout the drawings. In this embodiment, two kinds of cassette are selectively attachable to attachment portions 4C of an image forming apparatus. A cassette 4B may be selected from those shown in FIGS. 2 and 7A, 7B. The cassette 4B shown in FIG. 2, as mentioned above, has sheet aligning units 40a, 40b arranged side by side for containing stacks of small sized sheets in their aligning units. The cassette 4B shown in FIGS. 7A and 7B has a sheet aligning unit 40c for containing a single stack of large sized sheets in its aligning unit. The cassette 4B may be permitted to accommodate variously sized sheets therein by making side walls or the like of the sheet aligning unit movable.

Figure 7A:
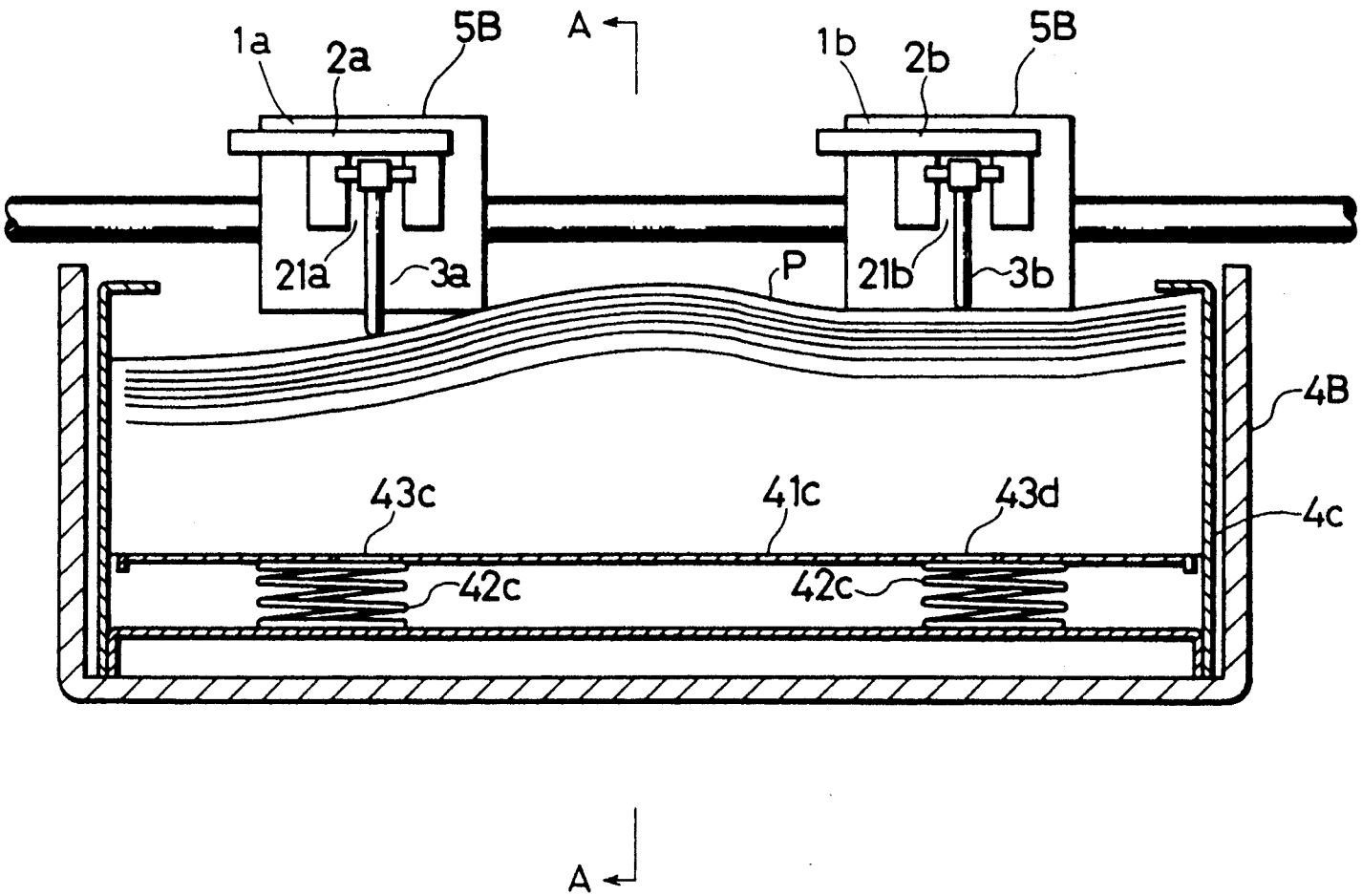
FIG. 7A is a sectional view showing a cassette containing a single stack of large sized sheets.
Figure 7B:
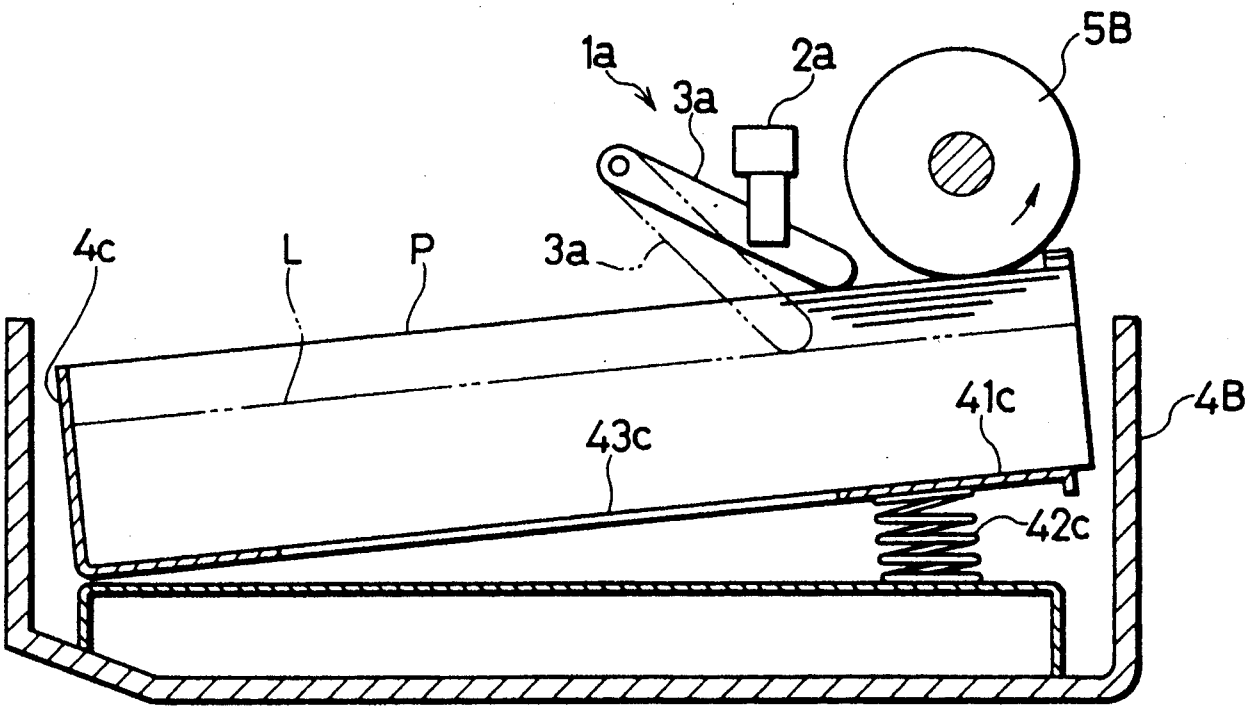
FIG. 7B is a sectional view taken along the line A—A in FIG. 7A.

The sheet aligning unit 40c containing a single stack of large sized sheets provided with a sheet holding plate 41c biased upwards by a helical spring 42c so that the uppermost ones of sheets P stacked thereon come to contact with the feed roller 5B at a suitable pressure. Further, as shown in FIGS. 7A and 7B, the holding plate 41c is formed with oblong slots 43c, 43d extending in a sheet feeding direction in specified positions thereof. The levers 3a, 3b are designed to rotate down to the vertical position due to the weight thereof when the sheets P run out.

The photointerrupters 2a, 2b are turned on when the levers 3a, 3b are located in clearances 21a, 21b between the light emitting elements and photodetectors as represented by solid line in FIG. 3, while being turned off when the levers 3a, 3b are rotated down to be located in the aforementioned oblong slots 43c, 43d.

Figure 8:
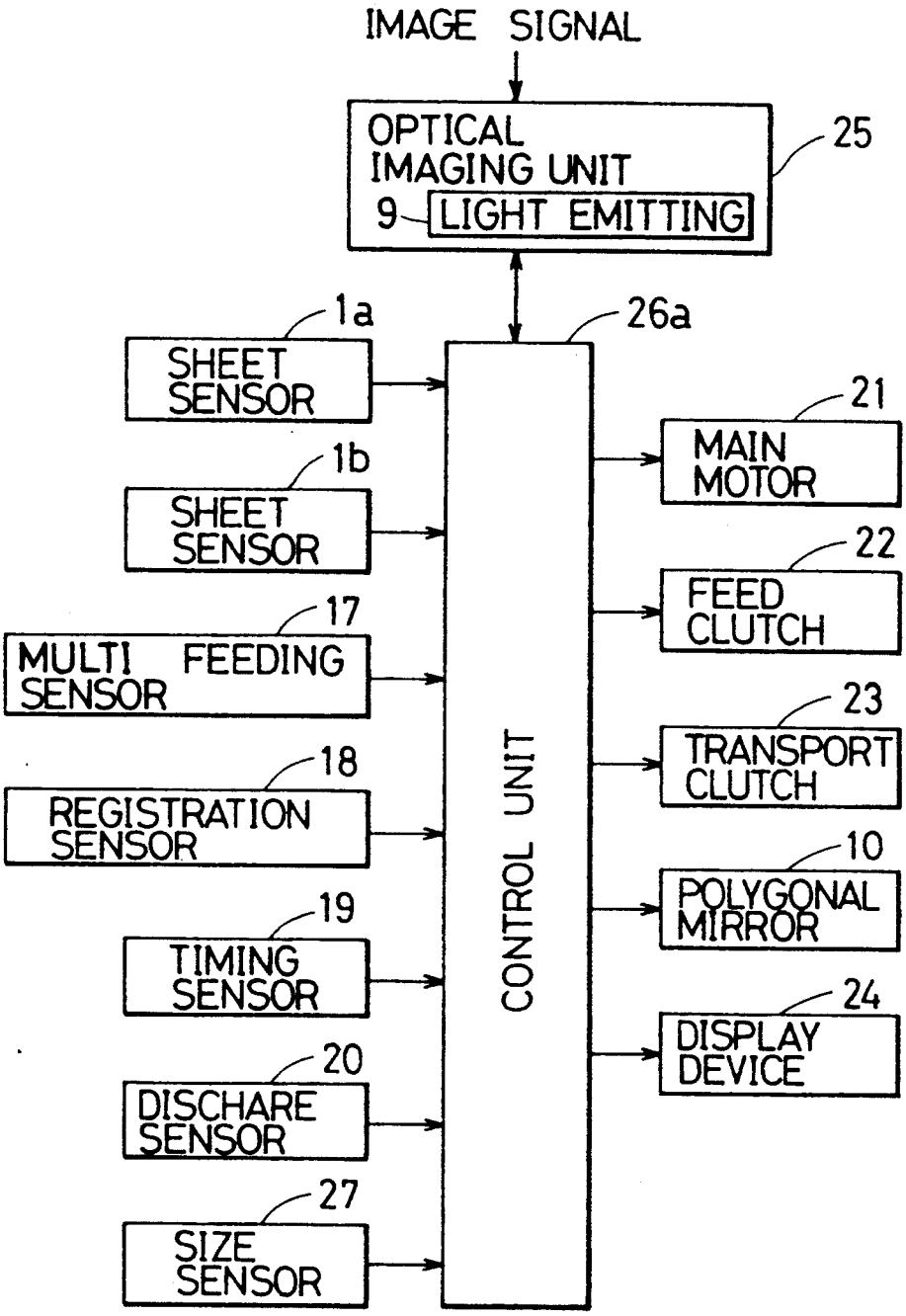
FIG. 8 is a block diagram showing a construction of another control system.

A construction of a control system of this embodiment will now be described with reference to a block diagram shown in FIG. 8.

In this control system, a size detector switch 27 is connected to a control unit 26a. The size detector switch 27 detects whether stacks of small sized sheets are contained side by side or a single stack of large sized sheets is contained in the cassette 4B. More specifically, the switch 27 automatically detects the size of sheets contained in the cassette 4B by checking a magnet, a bar code, or the like arranged at the cassette 4B for identifying the size of sheets. The switch 27 is turned off when the small sized sheets are contained in the cassette 4B, while being turned on when the large sized sheets are contained therein. When the sheet size is set through an unillustrated operation unit, the switch 27 is turned on or off according to the set content.

The control unit 26a determines the absence of sheet when the photointerrupters 2a, 2b of the sheet sensors 1a, 1b are both turned off and the size detector switch 27 detects that the cassette 4B contains the large sized sheets, and stops the sheet feeding operation. In addition, the control unit 26a sends a display device 24 a signal indicating the absence of sheet.

Figure 9:
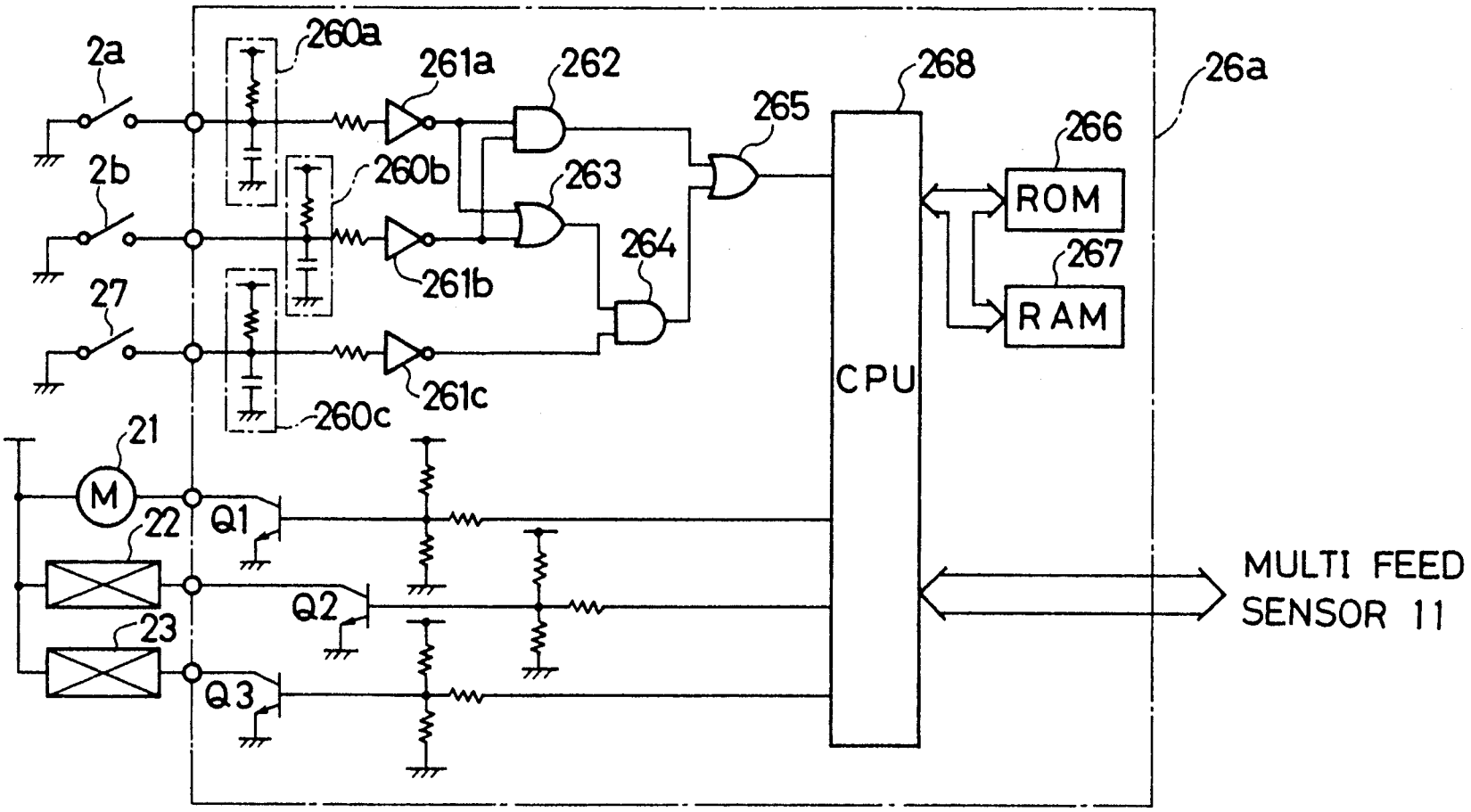
FIG. 9 is a circuit diagram showing a specific construction of another control system.

A specific construction of the control unit 26a will be described next with reference to a circuit diagram shown in FIG. 9.

In this control unit 26a, in place of the NOR circuit 262a, an integrating circuit 260c an inverter 261c, AND circuits 262, 264, OR circuits 263, 265 are provided.

The integrating circuit 260c outputs a high signal to the inverter 261c when the size detector switch 27 is off, while outputting a low signal to the inverter 261c when the size detector switch 27 is on.

The inverter 261c inverts an output signal of the integrating circuit 260c, and outputs the inverted signal to the AND circuit 264. The inverter 261c has a hysteresis characteristic so as to reduce the effect of chattering or the like of the photointerrupters 2a, 2b and size detector switch 27 in cooperation with the integrating circuit 260c.

The AND circuit 262 outputs a high signal to the 0R circuit 265 when the inverters 261a, 261b output both high signals while outputting a low signal to the OR circuit 265 when one of the inverters 261a, 261b outputs a low signal. In other words, the AND circuit 262 outputs the high signal to the OR circuit 265 only when the photointerrupters 2a, 2b are both on.

The OR circuit 263 outputs a high signal to the AND circuit 264 when receiving the high signal from at least one of the inverters 261a, 261b, i.e., when at least one of the photointerrupters 2a, 2b are on. The AND circuit 264 outputs a high signal to the OR circuit 265 upon receipt of the high signal from the OR circuit 263 when the inverter 261c outputs the high signal. i.e., when the size detector switch 27 is on. The OR circuit 265 outputs a high signal to the CPU 268 upon receipt of the high signal from at least one of the AND circuits 262 and 264.

Next, operations of the control unit 26a will be described. Description will be first given to a case where the cassette 4B (shown in FIG. 2) accommodating stacks of small sized sheets side by side therein is attached to the image forming apparatus.

When the sheets are contained in both the sheet aligning units 40a, 40b of the cassette 4B, the photointerrupters 2a, 2b are both on, and thereby each of the inverters 261a, 261b outputs the high signal and the AND circuit 262 outputs the high signal to the OR circuit 265. Then, the OR circuit 265 outputs the high signal to the CPU 268 regardless of the level of the signal output from the AND circuit 264. Upon receipt of the high signal from the OR circuit 265, the CPU 268 determines the presence of sheets in the cassette 4B.

When the sheet runs out in either one of the sheet aligning units 40a, 40b, the photointerrupter corresponding to the aligning unit containing no sheet is turned off. Thereby, one of the inverters 261a, 261b outputs the low signal, and accordingly the AND circuit 262 outputs the low signal. On the other hand, the size detector switch 27 is turned off upon detecting that the cassette 4B contains the small sized sheets, and thereby the inverter 261c outputs the low signal and the AND circuit 264 outputs the low signal regardless of the level of the signal output from the OR circuit 263. The OR circuit outputs the low signal since both the AND circuits 262 and 264 output the low signals, and therefore the CPU 268 determines the absence of sheet in the cassette 4B.

A description will be next given of a case where the cassette 4B (shown in FIGS. 7A and 7B) accommodating the single stack of large sized sheets therein is attached to the image forming apparatus.

Figure 10A:
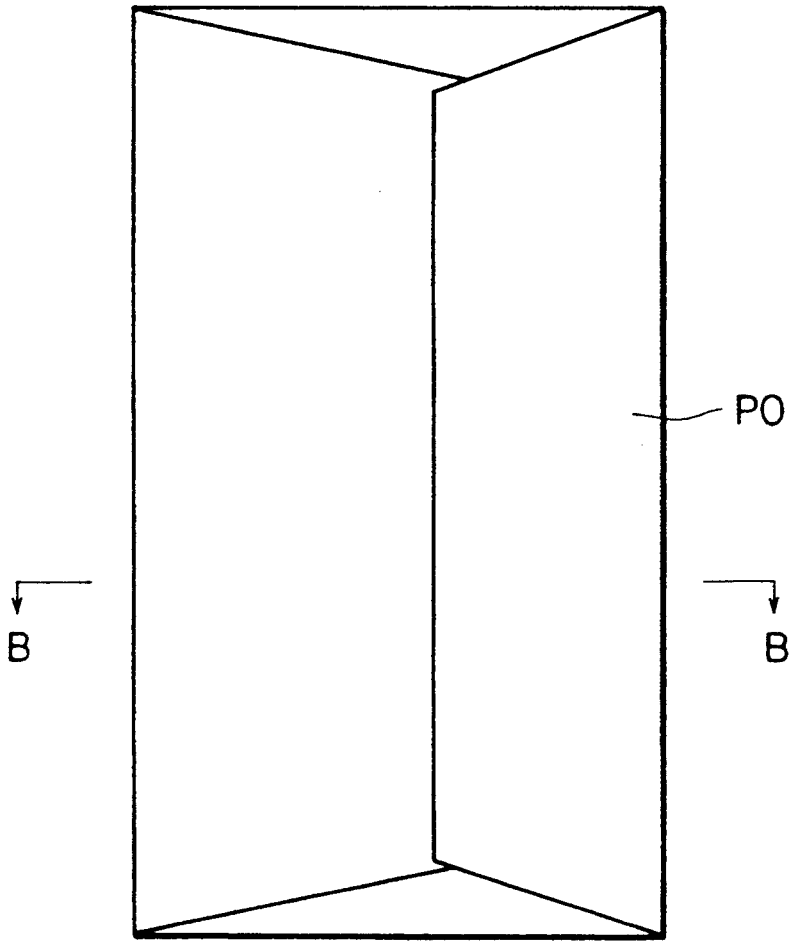
FIG. 10A is a front view of an envelop.
Figure 10B:
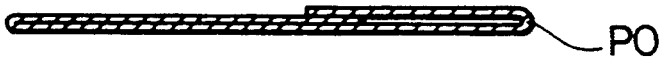
FIG. 10B is a sectional view taken along the line B—B in FIG. 10A.

Specifically, a description will be given to a case where large sized envelopes are used as large sized sheets. An envelop PO has an end portion thereof turned up in a finished form as shown in FIGS. 10A and 10B, with the result that the envelop PO has the nonuniform thickness. Thus, when a plurality of envelopes PO are stacked up on the holding plate 41c of the cassette 4B, the nonuniformity of the thickness of that stack in a widthwise direction of the cassette 4B becomes greater as shown in FIG. 7A.

For example, even if the uppermost one of the envelopes PO is in contact with the lever 3b of the sheet sensor 1b properly, turning the photointerrupter 2b on, the lever 3a of the sheet sensor la may rotate downwards, thereby leaving away from the photointerrupter 2a as represented by phantom line in FIG. 7B since the stack of the envelopes PO warps downward where the lever 3a comes to contact therewith. Accordingly, the photointerrupter 2a is turned off, and thereby the inverter 261b outputs the high signal while the inverter 261a outputs the low signal. Consequently, the AND circuit 262 outputs the low signal while the OR circuit 263 outputs the high signal.

On the other hand, the size detector switch 27 is turned on upon detecting that the cassette 4B contains the large sized sheets. Accordingly, the inverter 261*c* outputs the high signal, and the AND circuit 264 outputs the output (high signal) of the OR circuit 263 as it is. In other words, the AND circuit 264 outputs the high signal, which is output to the CPU 268 through the OR circuit 265. Upon receipt of the high signal, the CPU 268 determines the presence of sheet in the cassette 4B.

When there is no sheet in the sheet aligning unit 40*c*, the photointerrupters 2*a*, 2*b* are both turned off. Thereby, the inverters 261*a*, 261*b* both output the low signals, and the AND circuit 262 and the OR circuit 263 output the low signals. Accordingly, the AND circuits 262 and 264 both output the low signals, and the OR circuit 265 outputs the low signal to the CPU 268, which in turn determines the absence of sheet in the cassette 4B.

In this way, if the sheet runs out in either one of the sheet aligning units 40*a*, 40*b* when the size detector switch 27 detects that the cassette 4B contains the small sized sheets, the absence of sheet is determined, and thereby the feed clutch 22 is disengaged to stop the sheet feeding operation. Accordingly, an occurrence of an event can be prevented where the transfer device and the transport path downstream therefrom are smeared due to the fact that the small sized sheet dispensed from only the one aligning unit is transported.

On the other hand, if the photointerrupters 2*a*, 2*b* of the sheet sensors 1*a*, 1*b* are both turned off when the size detector switch 27 detects that the cassette 4B contains the large sized sheets, the absence of sheet is determined and the sheet feeding operation is stopped. Accordingly, an erroneous detection can be prevented which is caused by the warping of sheets due to the nonuniform thickness of the large sized sheets.

Although two sheets are fed simultaneously side by side in the foregoing embodiment, three or more sheets may be fed in the similar manner. In this case, the same number of sheet sensors may be provided as that of the stacks of sheets contained in a cassette.

The foregoing embodiment is described with respect to an image forming apparatus. However, the invention is generally applicable to any apparatus for feeding a sheet material.

Moreover, although the foregoing embodiment is described with respect to a cassette 4B, the invention is also applicable to a feed cassette 4A. Specifically, similarly to a cassette 4B, sheet sensors 1 are provided to detect the presence and absence of sheets in the cassette 4A. Also, a size detector switch 27 is provided to detect whether stacks of small sized sheets are contained side by side or single stack of large sized sheets is contained in the cassette 4A. To respective attachment portions 4C, for example, are attached a cassette 4A containing a single stack of large sized sheets, and a cassette 4B containing stacks of small sized sheets side by side. The cassette 4A or cassette 4B is selectively placed in operation by an appropriate changing switch. In the case of the cassette 4A being selected, the absence of sheet is determined when all the sheet sensors 1 detects that the height of the stack has become lower than a predetermined height. If the cassette 4B is selected, the absence of sheet is determined when at least one of the sheet sensors 1 detects that the height of the stack has become lower than a predetermined height. The sheet feeding operation is stopped upon the determination of the absence of sheet.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sheet feeding arrangement comprising:

a feeder for feeding at least one sheet;

a cassette comprising means for holding at least a first stack of sheets, and biasing means for biasing sheets in said cassette upwards so as to bring uppermost sheets of said at least one stack into contact with the feeder;

a plurality of sheet detectors arranged in positions corresponding to the respective stacks of sheets for detecting the height of the respective stacks of sheets contained in the cassette means; said detectors being spaced apart in a direction perpendicular to the feed direction of said feeder;

control means responsive to outputs of said plurality of sheet detector means for determining the absence of sheets in the cassette means when at least one of the plurality of sheet detectors detects that the height of a stack of sheets thereunder has become lower than a predetermined height, and for stopping a sheet feeding operation by said feeder;

said cassette comprising means for holding a second stack of sheets spaced from said first stack in the direction perpendicular to the feed direction of said feeder, said sheet detector means comprising first and second detectors for detecting the heights of said first and second stacks, respectively, and said control means comprises means for stopping the sheet feeding operation in response to the detection by at least one of said detector means that the height of the respective stack is below said predetermined height;

said cassette being shaped to permit the selective loading of a single stack of sheets of larger size than the sheets of said first and second stacks, to replace said first and second stacks of sheets, with said first and second detectors positioned to detect the height of said single stack at spaced apart locations, and further comprising means for determining the presence of said single stack in said cassette, and wherein said control means is responsive to the detection of said single stack in said cassette for stopping said feeder only when said first and second detectors both detect the presence of sheets that the height of said single stack is below said predetermined height.

2. A sheet feeder comprising:

feeder means for feeding a plurality of sheets in a feed direction;

cassette means containing a plurality of stacks of sheets side-by-side in a direction perpendicular to said feed direction;

said feeder means being operable to simultaneously feed a plurality of said sheets in which said simultaneously fed plurality of sheets includes one sheet from each of said plurality of stacks;

a plurality of sheet detector means arranged in positions corresponding to each respective stack of sheets for separately detecting the height of said sheets in each of said stacks;

each of said sheet detector means being separately operable to determine when each stack of said plurality of stacks has become lower than a predetermined height; and control means responsive to each of said sheet detecting means to stop said simultaneous feeding of said sheets from said plurality of stacks when any one of said sheet detecting means detects that any one of said plurality of stacks has become lower than said predetermined height.

3. A sheet feeder according to claim 2 wherein said cassette means comprises biasing means for biasing said sheets in said stack toward said feeder means.

4. A sheet feeder according to claim 2 wherein said feeder means is operable to feed said plurality of sheets simultaneously side-by-side.

5. A sheet feeder according to claim 2 wherein at least one of said sheet detecting means comprises a pivotal lever operable to contact the uppermost sheet in the respective stack of sheets due to the weight of said lever.

6. A sheet feeder according to claim 2 wherein at least one of said sheet detecting means comprises a photointerrupter including a light emitting element and a photodetector, and a lever which is provided rotatably between said light emitting element and said photodetector and which comes into contact with the uppermost sheet in the respective stack in said cassette means due to the weight of said lever.

7. A sheet feeder according to claim 2 wherein at least one of said sheet detecting means comprises informing means for informing an operator that the height of the sheets in the respective stack has become lower than said predetermined height.

8. A sheet feeder according to claim 2 wherein:

said cassette means comprises a first cassette unit disposed in a cassette holder means, said first cassette unit containing said plurality of stacks of sheets;

a second cassette unit containing a single stack of sheets, said first cassette unit being removable from said cassette holder means to provide for disposing said second cassette unit in said cassette holder means;

said plurality of sheet detection means being operable to separately detect the height of said single stack of sheets in said second cassette unit at spaced locations of said single stack;

cassette detector means for detecting whether the second cassette unit is disposed in said cassette holder means;

said control means being responsive to said cassette detector means and being responsive to said sheet detecting means to stop the feeding of sheets from said single stack when said cassette detector means detects that said second cassette unit is disposed in said cassette holder means and said plurality of sheet detector means detect that the height of said stack at said spaced locations has become lower than said predetermined height.

9. A sheet feeder according to claim 8 wherein the sheets in said single stack in said second cassette unit are larger than the sheets in said stacks in said first cassette unit.

10. A sheet feeder according to claim 8 wherein each of said sheets in said single stack of sheets in said second cassette unit has one part with one thickness and another part with another thickness.

11. A sheet feeder according to claim 8 wherein said sheets in said single stack of sheets in said second cassette unit are envelopes.

12. A sheet feeder comprising:

feeder means for feeding flat items in a feed direction;

holder means for holding a stack of said flat items;

at least two detecting means spaced from one another for separately detecting the height of said flat items in said stack at spaced locations of said stack;

each of said at least two detector means being separately operable to determine when the height of said stack at each of said spaced locations has become lower than a predetermined height; and control means having an operable mode which is responsive to each of said at least two detecting means to stop said feeding of said flat items from said stack when both of said at least two detecting means detects that each of said spaced locations has become lower than said predetermined height.

13. A sheet feeder according to claim 12 wherein said control means has another operable mode which provides for feeding of said flat items from said stack when one of said detecting means detects that the height of said stack at the location associated with said one detecting means is higher than said predetermined height and the other of said detecting means detects that the height of said stack at the location associated with said other detecting means is lower than said predetermined height.

14. A sheet feeder according to claim 12 wherein said flat items have at least one part which is thicker than another part.

15. A sheet feeder according to claim 12 wherein said flat items are envelopes.

16. A sheet feeder according to claim 12 wherein said holder means holds a single stack of said flat items, said single stack having a top flat item, each of said at least two detecting means having an operable member contacting said top flat item.

17. A sheet feeder according to claim 12 wherein said holder means is operable to interchangeably receive a first cassette means and a second cassette means, said single stack of flat items being disposed in said second cassette means;

said first cassette means being operable to hold at least two stacks of flat items side-by-side in a direction perpendicular to said feed direction;

said feeder means being operable to simultaneously feed a plurality of said flat items side-by-side in which said simultaneously fed plurality of flat items includes one flat item from each of said at least two stacks in said first cassette means;

said at least two detecting means being operable to separately determine when the height of each of said stacks in said first cassette means has become lower than said predetermined height;

said control means having another operable mode which is responsive to said at least two detecting means to stop said simultaneous feeding of said plurality of flat items from said at least two stacks in said first cassette means when any one of said at least two detecting means detects that any one of said at least two stacks in said first cassette means has become lower than said predetermined height.

18. A sheet feeder comprising:

feeder means for feeding a plurality of sheets in a feed direction;

retainer means retaining at least two stacks of sheets side-by-side in a direction perpendicular to said feed direction;

said feeder means being operable to simultaneously feed at least two of said sheets side-by-side in which said simultaneously fed sheets includes one sheet from each of said at least two stacks;

at least two sheet detector means arranged in positions corresponding to each respective stack of sheets for separately detecting the height of said sheets in each of said stacks;

each of said sheet detector means being separately operable to determine when each stack of said at least two stacks has become lower than a predetermined height; and control means responsive to said sheet detecting means to stop said simultaneous feeding of said at least two sheets from said at least two stacks when either one of said at least two sheet detecting means detects that either one of said at least two stacks has become lower than said predetermined height.

* * * * *